US006135658A

United States Patent [19]

Reele et al.

[11] Patent Number: 6,135,658

[45] Date of Patent: Oct. 24, 2000

[54] THERMAL PRINTER DONOR MEDIA WITH SINGLE TRACK CODE CONTAINING MULTIPLE DATA FIELDS AND APPARATUS FOR DETECTING AND READING THE SAME

[75] Inventors: Samuel Reele, Rochester; Michael G. Schwartz, Spencerport, both of N.Y.

[73] Assignee: Eastman Kodak Company, Rochester, N.Y.

[21] Appl. No.: 09/339,673

[22] Filed: Jun. 24, 1999

[51] Int. Cl.[7] ..... B41J 31/09

[52] U.S. Cl. ..... 400/240.3; 400/240; 400/240.4

[58] Field of Search ..... 400/240.3, 240.4, 400/240; 347/214, 177, 178

[56] References Cited

U.S. PATENT DOCUMENTS

| | | | |
|---|---|---|---|
| 4,347,112 | 8/1982 | Togami | 204/192.2 |
| 4,797,016 | 1/1989 | Lahr | 400/225 |
| 5,009,531 | 4/1991 | Koike | 400/248.3 |
| 5,144,331 | 9/1992 | Amano | 400/240.3 X |
| 5,185,315 | 2/1993 | Sparer | 503/227 |
| 5,232,293 | 8/1993 | Hibon et al. | 400/105 |
| 5,325,115 | 6/1994 | Tanahashi | 400/240.3 X |
| 5,385,416 | 1/1995 | Maekawa et al. | 400/205 |
| 5,445,464 | 8/1995 | Asakura et al. | 400/249 |
| 5,786,841 | 7/1998 | Bobb et al. | 347/217 |

FOREIGN PATENT DOCUMENTS

| | | |
|---|---|---|
| 0 645 251 A1 | 3/1995 | European Pat. Off. . |
| 0 785 083 A1 | 7/1997 | European Pat. Off. . |
| 8-90915 | 4/1996 | Japan . |
| 8-99453 | 4/1996 | Japan . |
| 9-314871 | 12/1997 | Japan . |
| 10-44512 | 2/1998 | Japan . |
| 95/24316 | 9/1995 | WIPO . |

*Primary Examiner*—John S. Hilten
*Assistant Examiner*—Minh Chau
*Attorney, Agent, or Firm*—Walter S. Stevens

[57] ABSTRACT

Thermal printer donor media element (10) with a single track of code including sequential code segments (30). The present donor media element (10) includes sequential color patches (12, 14, 16) which form multiple color groups (18) located along the length of the element (10), and the code segments (30) are arranged in corresponding repetitive groups located adjacent the color groups (18), the sequential code segments including fields of encoded data representative of at least donor media type, and color and location of successive ones of the color patches (12, 14, 16). Apparatus for detecting and reading the encoded data include a single sensor (38) and a processor (44) operable for accurately completing incomplete or incorrectly detected data.

18 Claims, 2 Drawing Sheets

THERMAL PRINTER DONOR MEDIA WITH SINGLE TRACK CODE CONTAINING MULTIPLE DATA FIELDS AND APPARATUS FOR DETECTING AND READING THE SAME

BACKGROUND OF THE INVENTION

The present invention relates to thermal printers and more particularly to a thermal printer donor media element having a single track code including multiple sequential data fields identifying parameters for enabling the printing process such as, but not limited to, media type, and color and location of successive color patches, and apparatus for detecting and reading the code.

Today's thermal printers are designed with two or more different color LEDs (typically two LEDs wherein one LED is blue and the second is green or three LEDs wherein one LED is blue, the second is green, and the third is red) and two or more sensors. Mechanically, the donor material is between the LEDs and sensors. The donor media roll contains three or more sections of different media color type in a specific serial order, repeating each pattern throughout the entire roll. Typically, three areas of color specific donor material is required for a photographic quality thermal hard copy print. For a typical donor, that sequence of color specific donor material may be yellow, magenta, and cyan. Other donor materials may be composed of a base sequence of four color specific donor areas: yellow, magenta, cyan, and black. Still other donor materials may additionally include a clear laminate in the sequence for coating the print with a photographlike finish. The particular sequence of donor material (whatever that may be) is repeated in a serial fashion to complete the entire roll of donor material.

For identifying the color of a particular donor material section, each LED simultaneously emits its specific wavelength spectra of light through the donor media section as the donor media is advanced through mechanical sprockets working the rollers of a roll of donor media. In real time, the sensors (typically one each for each LED) sense the media filtered light from each LED. The analog signal is either A/D (analog to digital converted) or compared to a reference and a digital high or low voltage is outputted and either of which are sampled in real time. With the digital data from each LED and using boolean algebra logic, the type (color) of the section of media (immediately between the LEDs and sensors is determined. This information is used to define the color type of media material and sense the leading edge of the next section of donor media material both of which are used by the printer CPU (central processing unit) to perform the correct printing process of which a typical process is described in the next paragraph.

In producing a thermal hard copy output, donor material (usually the least thermally active color) is positioned over the thermal paper. Mechanical rollers, edge and color sensors are used to recognize and position the desired donor material color over the thermal output paper. A thermal head, in which pixels (typically 300 per inch) are arranged in a linear fashion, is positioned at the edge of the thermal output paper, the donor material being located between the thermal head and the thermal output paper. Digitized control data is then applied to each pixel simultaneously (usually pulse modulated) such that a row or line of one color is printed onto the thermal paper. Through stepper motors and mechanics, and control logic, either the thermal print head or thermal output paper is advanced one line or row and the thermal transfer process is repeated for that row. This whole sequence is repeated until one color is thermally transferred onto one full sheet of desired thermal output paper. The thermal paper is projected, donor material is advanced to the next color area, and the thermal output paper is re-inserted. The LED sensor system is used to determine the type of media and the leading edge of the new media section. The entire process is repeated until the next color in the sequence is transferred onto the thermal output paper. This process is repeated again with donor material advancing to the next color area until all colors of the donor material are transferred or thermally printed onto the thermal output.

With two or more LEDs and sensors, the above described system has cost disadvantages as well potential robustness issues. Robustness can be low for a two LED system with today's state of the art in LED emission and detection. As one improves robustness with a three LED system, cost is further disadvantaged. As an additional problem, it has been found that, in the event the printer is unable to recognize a color, the printer may go to an indeterminate state, such that the printing operation is interrupted or halted, resulting in an incomplete output.

It is also known to provide machine readable indicia such as bar codes and the like in tracks of code or marks on the donor media itself, or on a cartridge, case or spool containing the donor media, which respective tracks typically include information relating to various parameters such as donor type, identification and location of color segments or patches, as well as metering or timing marks to enable more accurately reading data streams that are detected or sensed at varying speeds. Reference, for example, U.S. Pat. No. 5,009,531 entitled "Color Ink Ribbon and Printer Using this Ribbon" issued Apr. 23, 1991 in the name of Seiji Koike which discloses the use of a track of bar coded color recognition marks, a track of speed detection marks, and a compensation coefficient on a body of the ink ribbon for determining identity of color portions on the ink ribbon. Reference also U.S. Pat. No. 5,786,841 entitled "Single Track of Metering Marks on Thermal Printer Media" issued Jul. 28, 1998, in the name of Mark A. Bobb et al. which discloses the use of a single track of differently spaced groups of metering marks on thermal printer donor media for identifying the color and location of the beginning of color patches on the media.

However, the Koike ribbon requires multiple sensors for detecting the various marks and compensation coefficients so as to suffer from the disadvantages discussed above, and Bobb et al. requires metering marks that are spaced sufficiently far apart so as to require substantial movement of the media for accurate detection of the groups for ascertaining the color and location of the beginning of the next color patch, so as to add to the printing time and increase the potential for error in color determination. Also, although the metering marks can be utilized for identifying color and location of color patches, additional means such as those discussed above are still required for accurately achieving desired color robustness. This is because in the thermal printing process, different types of donor media typically require different thermal energy levels for producing a particular robustness of a given color. Thus, some information, such as the media type, or a compensation coefficient or factor, must still be provided to enable determining the required energy level for the particular robustness.

Therefore, there is a need to provide a system for storage of data on thermal printer donor media including information enabling making accurate color and robustness determinations, which data can be detected using simpler detection means, such as a single LED/sensor set, and which information can be accurately determined with minimal movement of the donor media and when less than all of the data is read.

SUMMARY OF THE INVENTION

An object of the present invention is to provide a thermal printer donor media element with a single track of code that can include multiple data segments including fields of information identifying such different parameters as the media type, color patch color and location thereof, and apparatus for detecting the code and determining the information, even when a data field is incomplete and/or inaccurately detected.

With this object in view, the present invention resides in a thermal printer donor media element for use in a thermal printer, including sequential color patches which form multiple color groups located along the length of said element, and a single track of repetitive groups of sequential code segments located respectively adjacent the color groups, the sequential code segments including fields of encoded data representative of at least donor media type, and color and location of successive ones of the color patches.

According to an exemplary embodiment of the present invention, the code segments comprise bar codes detectable using a single optical sensor and light transmitted through the donor media element or reflected thereby.

According to another exemplary embodiment of the present invention, the single track of code is located adjacent an edge of the color patches.

A feature of the present invention is the provision of a sensor positioned and operable for detecting the code segments and generating information representative thereof.

Another feature of the present invention is the provision of a processor connected to the sensor and operable for receiving the information representative of the code segments and determining whether the information is complete and accurately detected, and if incomplete or inaccurately detected, then determining the needed information from the incomplete information and stored information. The stored information can include information from previously detected code segments and/or other information which can be compared to or supplemented to the detected information for completing it.

These and other objects, features and advantages of the present invention will become apparent to those skilled in the art upon a reading of the following detailed description when taken in conjunction with the drawings wherein there are shown and described illustrative embodiments of the invention.

BRIEF DESCRIPTION OF THE DRAWINGS

While the specification concludes with claims particularly pointing out and distinctly claiming the subject matter of the present invention, it is believed the invention will be better understood from the following detailed description when taken in conjunction with the accompanying drawings wherein:

DETAILED DESCRIPTION OF THE INVENTION

The present description will be directed in particular to elements forming part of, or cooperating more directly with, apparatus in accordance with the present invention. It is to be understood that elements not specifically shown or described may take various forms well known to those skilled in the art.

Figure 1:
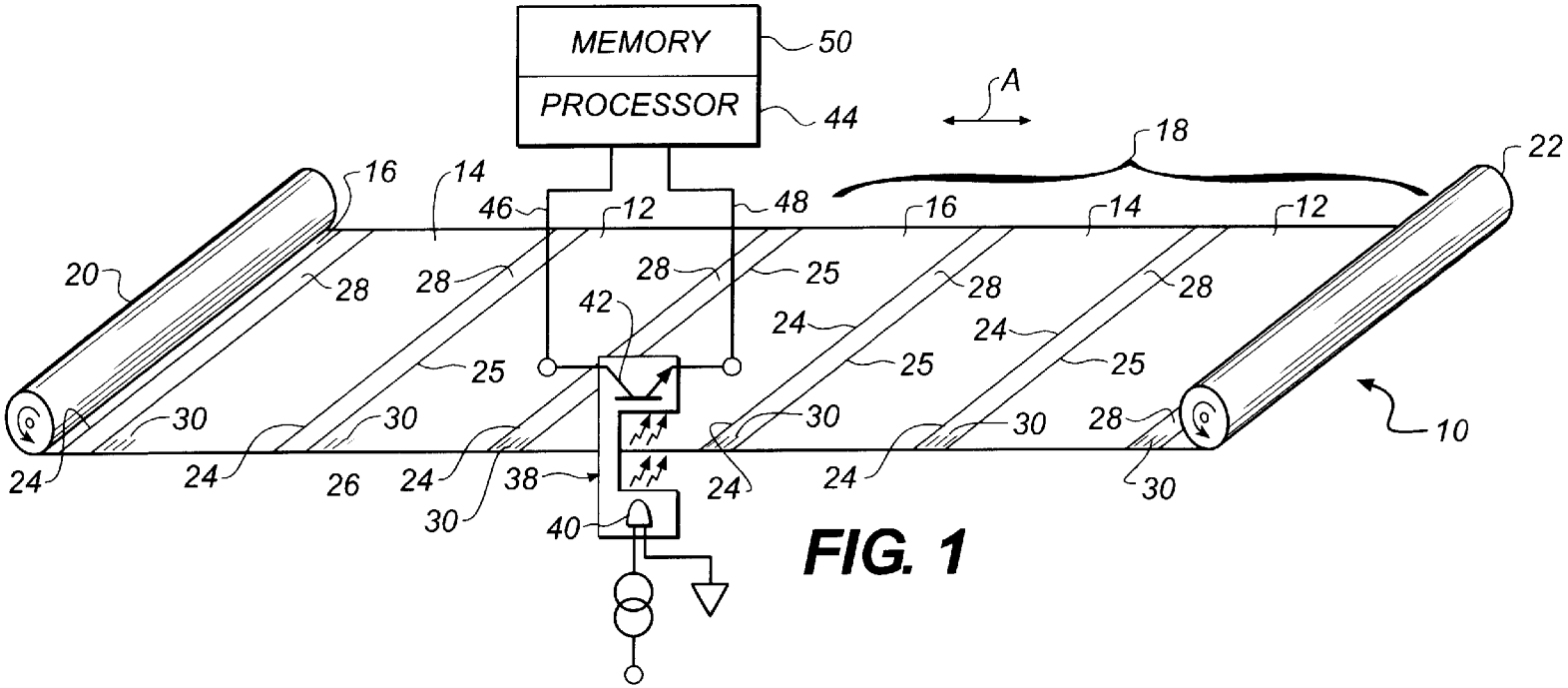
FIG. 1 is a perspective view of a thermal printer donor media element including a single track code according to the invention, and apparatus for detecting and reading the code.

Therefore, referring to FIG. 1, there is shown a thermal printer donor media element 10 adapted for use with a conventional thermal printer. Media element 10 includes a plurality of sequential color patches 12, 14 and 16 of yellow, magenta and cyan donor material, respectively, extending along the length of element 10, denoted by the arrow A. Each sequence of patches 12, 14 and 16 forms a color group 18, element 10 including multiple color groups 18 along its length. Element 10 is shown rolled at its longitudinal ends 20 and 22 to economize its size.

Element 10 can be unrolled in either direction to advance patches 12, 14 and 16 to a printing position in relation to a printer print head, each patch 12, 14 and 16 having an edge identified as its leading edge 24 to denote the beginning of the patch. Here, the leading edge 24 is denoted as the right hand edge of each patch, indicating that the element 10 is unrolled in a left to right fashion when used, as shown by the arrows on ends 20 and 22.

Element 10 includes a side edge 26 extending along its length adjacent to a corresponding edge of patches 12, 14 and 16, and a margin 28 between a trailing edge 25 of each color patch and the leading edge 24 of the next succeeding color patch.

Figure 2:
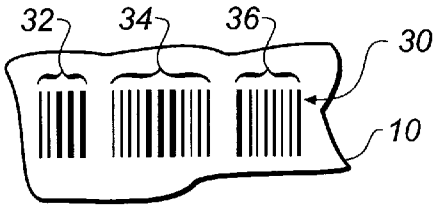
FIG. 2 is an enlarged fragmentary view of the donor media element of FIG. 1 showing a segment of the code.

A single track of repetitive groups of sequential code segments 30 is located along side edge 26 (typically clear) adjacent the color patches 12, 14 and 16. Referring also to FIG. 2, each sequential code segment 30 of element includes multiple fields (two or more) of encoded data 32, 34 and 36, here in the form of a bar code, field 32 including bar coded information representative of the type of the donor media element, field 34 including bar coded information representative of the color of the next succeeding color patch 12, 14 or 16, and field 36 including bar coded information representative of the location of the leading edge 24 of the next successive color patch. Because there are three different color patches in each color group 18, there are three different code segments 30 in each group of code segments, the code segments being correspondingly grouped, repeating with the repetition of the color groups. The code segments 30 preceding each of the color patches can be located anywhere as desired on element 10 as long as the code segments are detectable using a single sensor. Here, as examples, the code segments 30 are located in the margin 28 preceding the color patches as shown toward the right in FIG. 1, and alternatively, within an unused area of the preceding color patch as shown toward the left. It is understood that any combination thereof for each of the three or more fields of encoded data 32, 34 and 36 can be realized.

Figure 3:
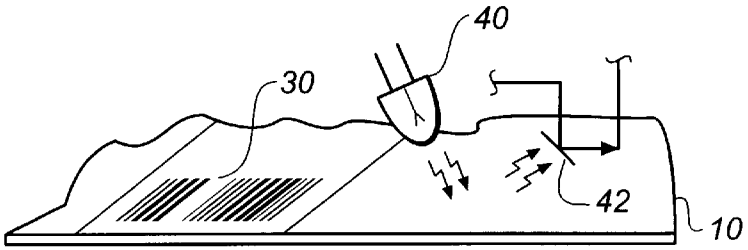
FIG. 3 is another perspective view of the donor media element of FIG. 1 showing alternative apparatus according to the invention for detecting the single track of code thereof.

In either location shown, color segments 30 are detectable using a single sensor 38, in FIG. 1 a LED/phototransistor combination being shown including a LED 40 positioned beneath element 10 for emitting light through element 10 to a silicon phototransistor or phototransistor array 42 located above element 10 for sensing the contrasts in the transmitted light effected by the bar codes of code segments 30 as element 10 is moved lengthwise relative to sensor 38. Referring also to FIG. 3, as an alternative, both LED 40 and phototransistor 42 can be located on the same side of element 10, the emitted light from LED 40 being contrastingly reflected by the bar codes of code segments 30 for detection by phototransistor 42. Phototransistor 42 is connected to a processor 44 via conductive paths 46 and 48 and is operable for generating a signal stream including information representative of the detected fields of bar codes for receipt by processor 44 over one or both of conductive paths 46 and 48. Processor 44 can be any suitable conventional microprocessor or other computer processor such as, but not limited to, a printer CPU, and is accompanied by a conventional external or internal memory 50 operable for receiving and storing information.

Figure 4:
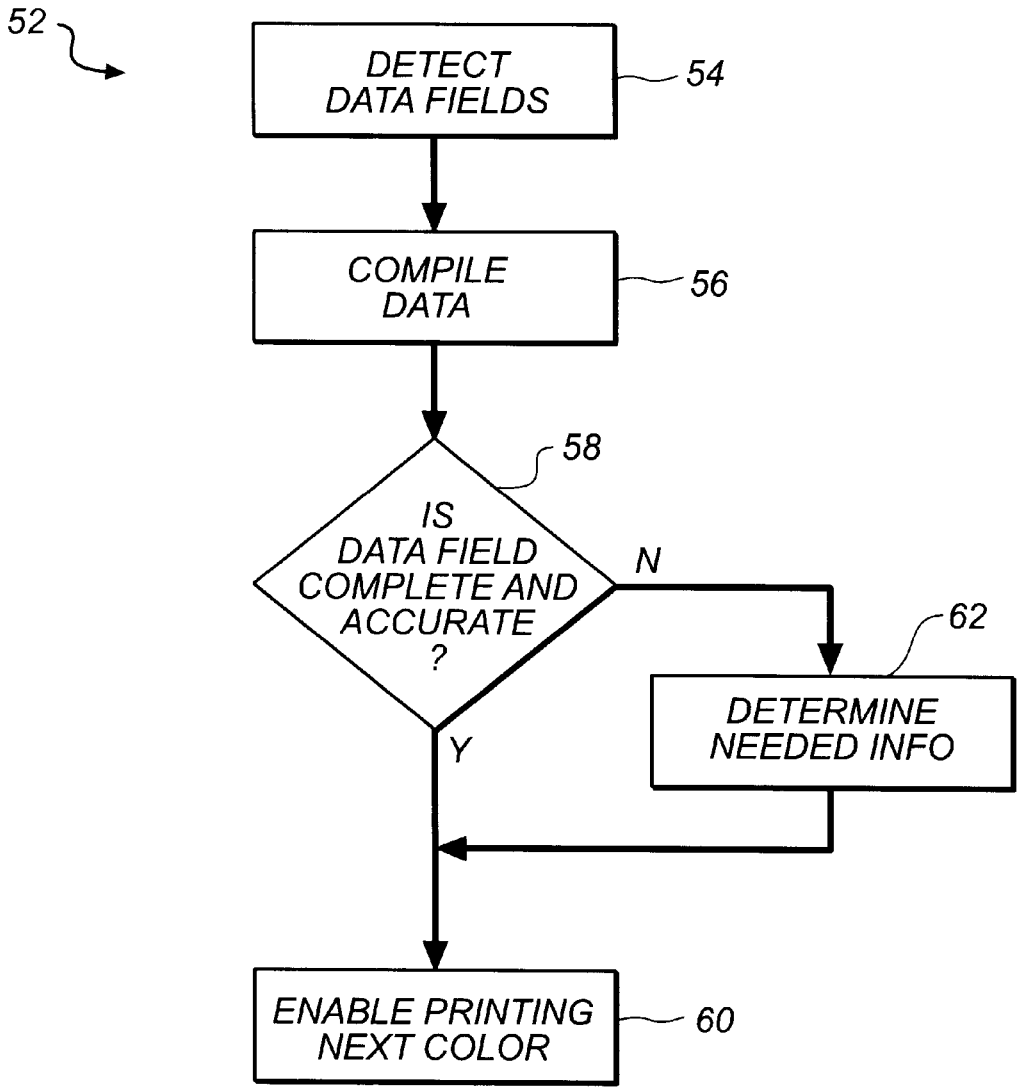
FIG. 4 is a flow diagram illustrating steps of operation of the apparatus of the invention.

Code segments 30, sensor 38, processor 44 and memory 50 are operable as a system. Referring to FIGS. 1 and 4 wherein a flow diagram 52 illustrating operation of the system is shown, as the data fields of code segments 30 are detected by passage by sensor 38, a signal stream from sensor 38 is received by processor 44 as denoted by block 54. Processor 44 next compiles the sensed data as denoted by block 56. Then, as denoted at decision block 58, processor 44 determines whether each data field is complete. This can include determining also whether the information is accurate, that is, whether the detected information is correct. This can be done by comparing the detected information to stored information in memory 50 representative of previously detected fields or model information for the fields stored in look up tables or the like in memory 50. If each data field is complete and accurate, processor 44 enables the next printing step, for instance, to advance to the next color patch, as denoted at block 60. If a data field is not complete and accurate, the needed information is determined or created as denoted at block 62 before the next printing step is enabled.

The needed information is determined using the information stored in memory 50. This stored information can include, but is not limited to, the stored information from previously detected fields, as well as predetermined or earlier inputted information which can be in readable form only, such as the model information from the look up tables, and information regarding the media type, order of color patches and colors thereof, as well as color intensity information, and the like which is known in advance. Since the color patches are arranged in a known repetitive order, if complete information regarding any previously detected code segment for a particular element 10 is stored, and the number of intervening color patches or code segments is known, then the needed information for a subject color patch can be determined from a look up table. Further, processor 44 can use means such as fuzzy logic and a detected state change or other routines to determine leading edge location and the like. Color intensity can be controlled very exactly and consistently for a particular donor media element such that if the donor media type is known, then contemporaneous color intensity detection apparatus can be eliminated and the color of a particular color patch identified using the present coded information. Here, it should be understood that by donor media type, it is contemplated that this could include any information which enables the printer to accurately produce desired colors using the media. As examples, this can include, but is not limited to, an identifying factor or a coefficient which enables the printer to make a determination of the needed energy level for accurately producing color robustness.

The mechanical arrangement of donor media element 10 described above is but one example. Many different configurations are possible.

For example, it may be appreciated from the description hereinabove that the color groups of the donor media element can include fewer or more color patches, such as black color patches and/or laminant patches applicable over a print for providing a photograph-like finish.

It may also be appreciated that the code segments may be located elsewhere, such as coincident with or overlaying a portion of the color patches, as desired.

It may also be appreciated from the description hereinabove that the present donor media elements may be removed from a printer and replaced with only detection of a single code segment being required to resume operation.

It may additionally be appreciated from the description hereinabove that the present system enables increasing the speed of the printing process by providing information relating to a subsequent color to be printed, such as the identity of the color and location thereof, during the printing of the current color, such that when printing of the current color is complete, the printer can more quickly proceed to the next color. For example, currently the data required for printing a particular color is typically accumulated and loaded in batch or job form into a buffer prior to the printing step for that color. Such data can include, but is not limited to, leading edge location information, color information, and energy level required to produce desired robustness. The printing step does not begin until the required information is accumulated in the buffer. This can result in momentary pauses in the printing operation as the information for the new color is collected and loaded into the buffer. With the present system, in contrast, while a color is being printed, the encoded data identifying the next color can be detected and read, and the required information for the new color loaded into the buffer as the current color is still being printed. For example, after the first half of the current color has been printed, the information in the buffer relating to that portion of the batch or job can be unloaded from the buffer and replaced with the information for printing the first half of the next color, then after the second half has been printed, that information can be replaced with the information for the second half of the next color, thus eliminating or substantially reducing the momentary pause. Still further, during the printing of a color, information identifying the location of the remaining unused portion of the color patch can be determined with reference to the adjacent code segment and this information stored, such that when the color patch is to be used again, the printer can go directly to the unused portion.

Therefore, what is provided is a thermal printer donor media element including a single track of code containing all of the necessary information for enabling the printing operation, including donor type, colors and beginning location of color patches, and the like, to eliminate the need for multiple sensors and the cost and other disadvantages associated therewith. A system is also provided which enables detecting and reading the encoded information, including a sensor for detecting the encoded information and a processor for decoding the information operable for determining missing and inaccurate information using stored information.

PARTS LIST

10 . . . donor media element
12 . . . patch
14 . . . patch
16 . . . patch
18 . . . color groups
20 . . . end

22 . . . end
24 . . . leading edge
25 . . . trailing edge
26 . . . side edge
28 . . . margin
30 . . . code segment
32 . . . data field
34 . . . data field
36 . . . data field
38 . . . sensor
40 . . . LED
42 . . . phototransistor
44 . . . processor
46 . . . conductive path
48. . . conductive path
50 . . . memory
52 . . . flow diagram
54 . . . block
56 . . . block
58 . . . decision block
60 . . . block
62 . . . block

What is claimed is:

1. A thermal printer donor media element for use in a thermal printer, comprising:

sequential color patches which form multiple color groups located along the length of said element; and a single track of repetitive groups of sequential code segments located respectively adjacent to the color patches, the sequential code segments including encoded data means for representing at least donor media type, color and location of the leading edge of successive ones of the color patches.

2. The thermal printer donor media element of claim 1, wherein the data representative of the location of the successive ones of the color patches includes data representative of the location of leading edges of the next succeeding color patches.

3. The thermal printer donor media element of claim 1, wherein each of the multiple color groups includes at least three of the sequential color patches.

4. The thermal printer donor media of claim 1, wherein the code segments are optically detectable.

5. The thermal printer donor media of claim 4, wherein the code segments comprise bar codes.

6. The thermal printer donor media of claim 1, wherein the single track is located adjacent to a side edge of the media.

7. The thermal printer donor media of claim 1, wherein the code segments are located intermediate the color patches of the groups.

8. A system for determining information relating to thermal printer donor media, comprising:

a thermal printer donor media element having sequential color patches which form multiple color groups located along a length of said element;

a single repetitive sequence of code segments located adjacent to the sequential color patches, said code segments each including encoded data field means for representing media type leading edge location information of successive ones of the color patches including color information thereof; and a sensor positioned and operable for detecting the code segments and generating information representative thereof.

9. The system of claim 8, further comprising a processor connected to the sensor and operable for receiving the information representative of the code segments and determining whether the information is complete, and if incomplete, determining needed portions of the information from stored information.

10. The system of claim 8, wherein the stored information includes information from previously detected code segments.

11. The system of claim 8, wherein the location information of the successive ones of the color patches includes information representative of the location of a leading edge of the next succeeding color patch.

12. The system of claim 8, wherein each of the multiple color groups includes at least three of the sequential color patches.

13. The system of claim 8, wherein the code segments are optically detectable.

14. The system of claim 13, wherein the code segments comprise bar codes.

15. The system of claim 8, wherein the single track is located adjacent to a side edge of the media.

16. The system of claim 8, wherein the code segments are located intermediate the color patches, respectively.

17. The system of claim 8, wherein the stored information includes predetermined information from previously detected code segments.

18. The system of claim 8, wherein the stored information includes predetermined information regarding the media type, order of color patches and colors thereof.

* * * * *